United States Patent [19]

Vertegaal

[11] B 3,990,363

[45] Nov. 9, 1976

[54] METHOD AND DEVICE FOR PRINTING A WEB OR A RECTANGULAR PIECE OF MATERIAL

[75] Inventor: Jacobus Gerardus Vertegaal, Boxmeer, Netherlands

[73] Assignee: Stork Amsterdam N.V., Amstelveen, Netherlands

[22] Filed: Nov. 16, 1973

[21] Appl. No.: 416,589

[44] Published under the second Trial Voluntary Protest Program on January 27, 1976 as document No. B 416,589.

Related U.S. Application Data

[63] Continuation-in-part of Ser. No. 173,970, Aug. 23, 1971, abandoned.

[30] Foreign Application Priority Data

Oct. 7, 1970 Netherlands ..... 7014707

[52] U.S. Cl. ..... 101/129; 101/115

[51] Int. Cl.[2] ..... B41F 15/10; B41F 15/42

[58] Field of Search ..... 101/115, 129, 116, 119, 101/120, 182, 219

[56] References Cited

UNITED STATES PATENTS

| | | | |
|---|---|---|---|
| 2,893,310 | 7/1959 | Johnson | 101/182 |
| 3,541,953 | 11/1970 | Rochford | 101/219 X |
| 3,718,086 | 2/1973 | Vertegaal | 101/120 X |
| 3,774,533 | 11/1973 | Ichinose | 101/119 |
| 3,774,534 | 11/1973 | Ichinose | 101/119 |
| 3,834,307 | 9/1974 | Zimmer | 101/119 X |

FOREIGN PATENTS OR APPLICATIONS

| | | | |
|---|---|---|---|
| 2,054,570 | 5/1971 | Germany | 101/116 |

*Primary Examiner*—Edgar S. Burr
*Assistant Examiner*—R. E. Suter
*Attorney, Agent, or Firm*—Edmund M. Jaskiewicz

[57] ABSTRACT

A rotary screen printing machine has a number of cylindrical stencils each with an internal squeegee and at least one stencil has an impermeable area parallel to the center line of the stencil. The squeegee of the said stencil may be raised or lowered while the impermeable area is in contact with the material being printed such that the printing action may be interrupted during one or more revolutions of the stencil during continuous operation of the printing machine. The stencil will print only when the screen portion is in contact with the material and the squeegee is lowered. A pattern can thus be printed which has a repeat length greater than the circumference of a stencil.

2 Claims, 17 Drawing Figures

INVENTOR

BY

ATTORNEY

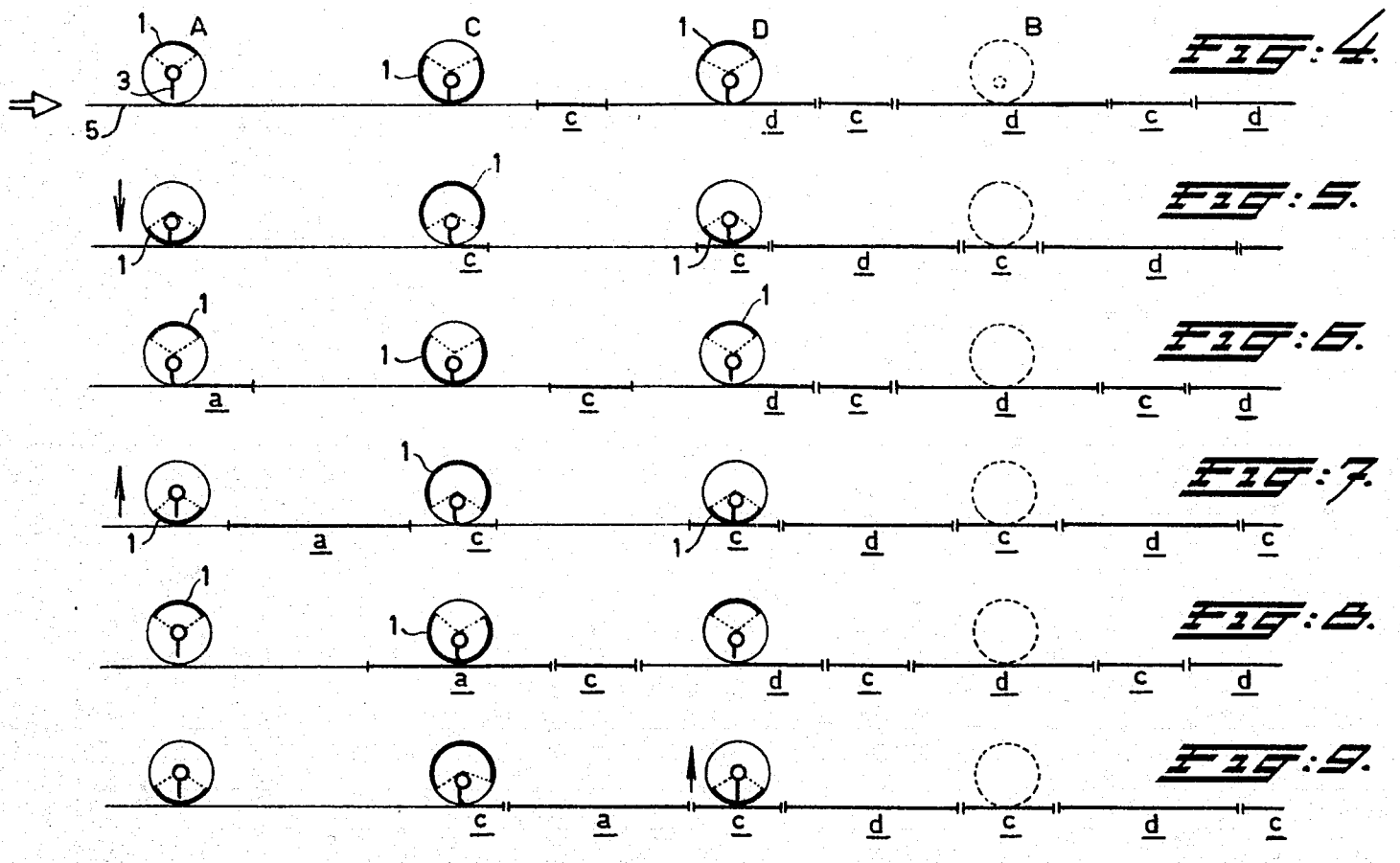
INVENTOR
BY
ATTORNEY

INVENTOR

BY

ATTORNEY

METHOD AND DEVICE FOR PRINTING A WEB OR A RECTANGULAR PIECE OF MATERIAL

The present application is a continuation-in-part of the copending application Ser. No. 173,970 filed Aug. 23, 1971, now abandoned.

The present invention relates to a method for printing a design by means of one or more screen stencils wherein at least a part of the design has a repeat length greater than the circumference of the stencil concerned. Such a method is so far only known for so-called flat printing and up to the present has not been feasible for cylindrical stencils. It could therefore only be performed by means of flat stencils. The product manufactured in this manner might comprise, for example, a bed sheet with a design printed on its head end. The mechanical process of manufacture is laborious and the rate of production thereof is limited.

The invention relates also to an apparatus for performing the method indicated hereinafter, which apparatus consists of a number of thin-walled cylindrical screen stencils each having an inner squeegee therein. The stencils are rotatably arranged over a common printing track, and means are provided for supporting and guiding the material to be printed along the printing track, while at least one of the stencils is provided with a squeegee which can be lifted.

The production of a continuous web or of rectangular pieces of material printed with a design having a repeat length which is greater than the circumference of each stencil will be possible according to the invention provided the following two features are applied:

using at least one thin-walled cylindrical stencil, provided with an internal squeegee and having a screen surface with at least one impermeable area parallel to the longitudinal axis of the stencil and, lifting and/or lowering periodically the squeegee of the afore-mentioned stencil(s), when the impermeable area passes by the squeegee, for selectively printing or not printing with the stencil concerned.

The impermeable area of each stencil allows, on the one hand, lifting the squeegee without producing a decrease in the intensity of the printed color. On the other hand, the squeegee can again be lowered into this area, whereby a quantity of dye or printing paste is again available in front of the squeegee at the moment that the perforated surface of the stencil, upon which is a design, approaches the squeegee.

It is an object of the present invention to provide a method and apparatus for printing a web or a rectangular piece of material with a design consisting of a marginal motif and a central motif different from the original motif. An example of such a product is a so-called kanga, in which the design usually is composed of:

a. an end motif extending in a direction transverse to the web (the so-called cross border);
b. a continuous longitudinal marginal motif;
c. a repetitive design or motif between two end motifs.

A kanga is a product used and manufactured in India and illustrated in FIG. 12 of the Specification. This product is characterized by the fact that a particular pattern of the design is repeated at a distance which is a multiple of the circumferential length of the stencil or screen with which the pattern in question is printed. The printing of such a special design has so far been mostly effected by hand, but will now be possible by means of the rotary screen printing process.

In carrying out the present invention in printing a kanga as described above, the strip covered by the stencil printing the end motif and extending in the longitudinal direction of the web can also be covered by one or more other stencils. Furthermore, at least a part of the repetitive design must be situated between two consecutive end motifs. Each stencil should have an impermeable area to allow for the lifting and lowering of the squeegee without affecting the intensity of the printed motif. For each color at least one cylindrical stencil is required. The impermeable area in a screen stencil provides that only a portion of the cylindrical stencil can be used for printing purposes. During the passing of this impermeable area 1 over the web 5 to be printed, there is no printing action and the squeegee 3 can be raised or lowered, without any influence upon the design to be printed. Normally, when one raises or lowers the squeegee during the printing operation, there will be a gradual decrease or increase in the intensity of the color to be printed. By means of the stencil shown in FIG. 1 it is possible to start printing with the correct intensity, and to interrupt printing also without any transitory zone.

Other objects and advantages of the present invention will be apparent upon reference to the accompanying description when taken in conjunction with the following drawings, which are exemplary, wherein:

FIGS. 4–11 show consecutive phases of the method for manufacturing a product according to FIG. 3;

FIG. 12 shows a variant of FIG. 3, the central design consisting of three parts;

FIG. 13 shows the arrangement of the cylindrical stencils for manufacturing the product according to FIG. 12;

Figure 15:
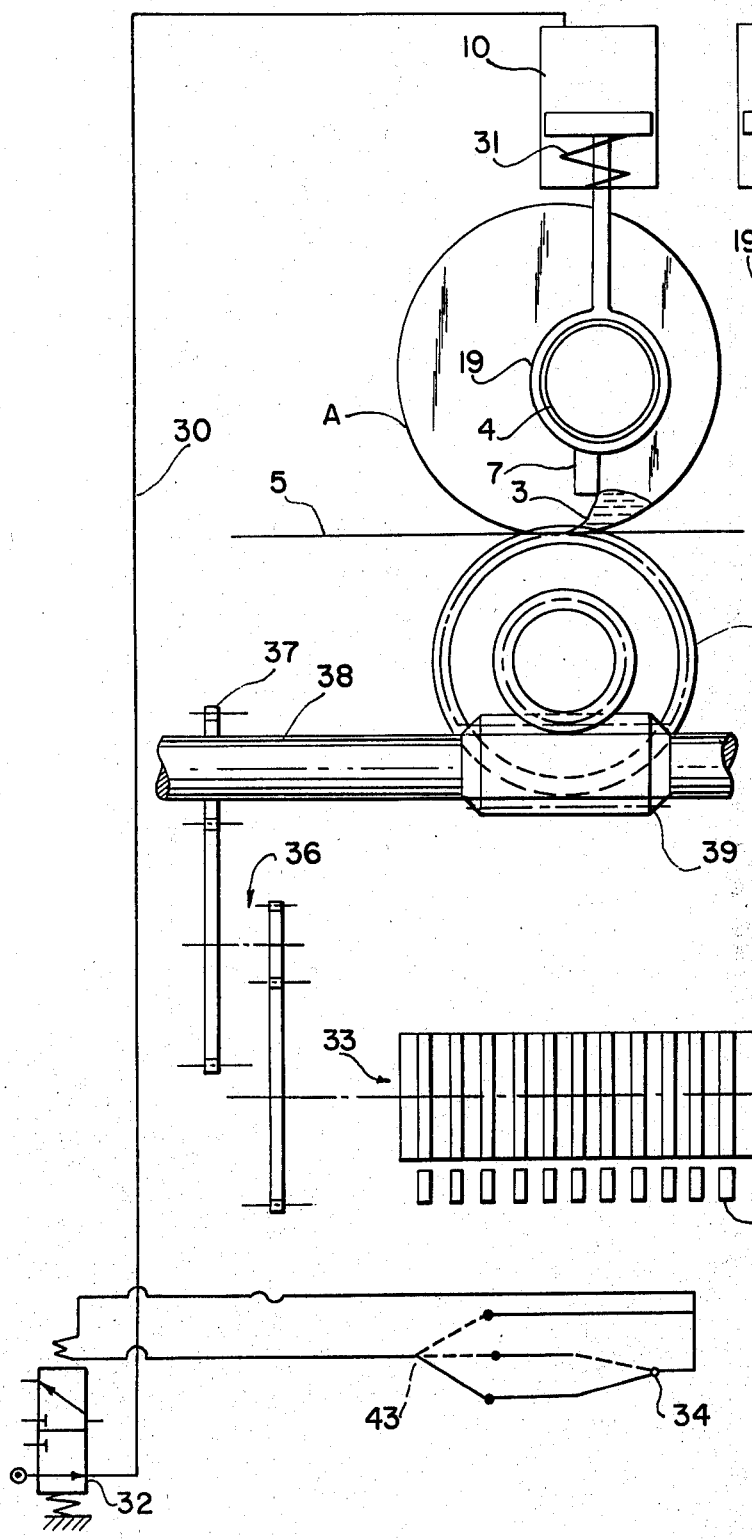
FIG. 15 is a diagrammatical view of the control system for raising and lowering of the squeegee in a timed sequence.
Figure 15A:
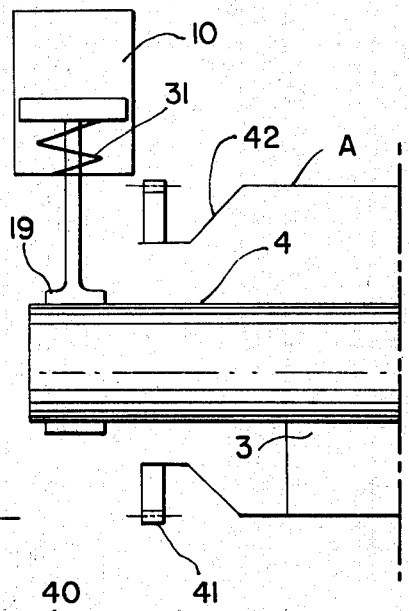
Figure 15B:
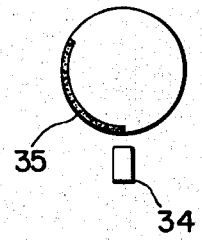

FIG. **15*a* is a diagrammatical view of a section through one end of the cylinder shown in FIG. 15; and FIG. 15*b* is an end view of an individual cam on the cam shaft of FIG. 15**.

Proceeding next to the drawings wherein like reference symbols indicate the same parts throughout the various views a specific embodiment of the present invention will be described in detail.

Figure 1:
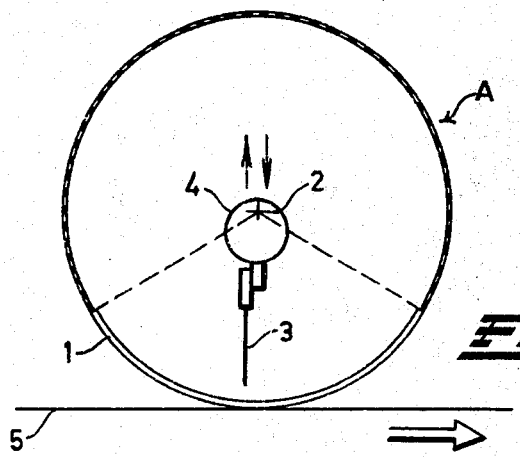
FIG. 1 is a cross section through a cylindrical stencil with a squeegee and with an impermeable area.

FIG. 1 shows a cylindrical stencil A provided with an impermeable area 1, which extends parallel to the longitudinal axis 2 of the stencil and over a portion of the circumference thereof. In the depicted case the area 1 covers an arc of about 120°. Within the stencil A is a squeegee 3 with a tubular holder 4 through which dye is fed, the latter in the conventional way being supported by its ends protruding from the stencil A, in the frame of the machine (not shown). This support allows a lifting and lowering of the squeegee.

Figure 2:
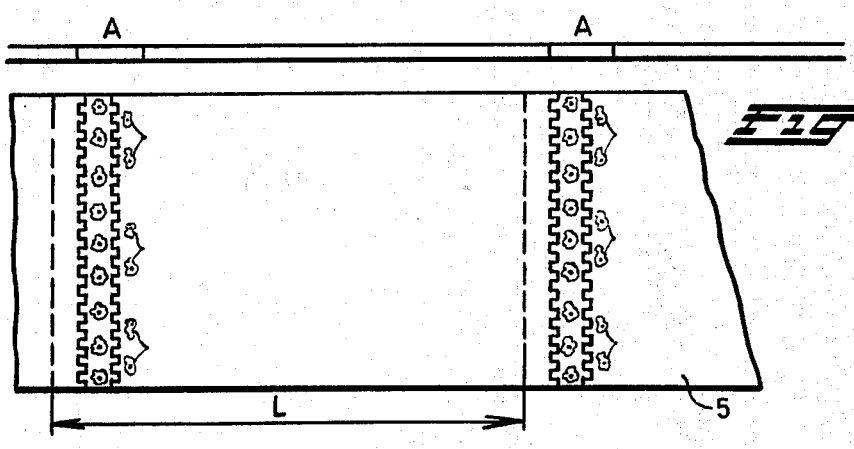
FIG. 2 shows a product which can be manufactured by means of the device according to FIG. 1.

FIG. 2 shows a product which can be manufactured by a proper application of the device according to FIG. 1. For that purpose one or more of such cylindrical stencils cooperate with a web 5, that is to say, as many stencils as there are colors worked up in the product. One example is a L depicted in FIG. 2 and which may consist of a bed sheet with a length of about 250 cm which at its head end is printed with an end motif a seen in FIG. 3. The stencil A has e.g. a circumference of 64 cm and the motif *a* has a length of about 40 cm and extends transversely the full width of the web 5. The method for manufacturing this product will next be described. Such a product may be a sari which is characterized by a design with a normal small repeat which is interrupted by a cross-border or end-motif of a different design.

After having brought the stencil(s) A into contact with the web 5 or closely adjacent thereto, the squeegee 3 being in the lifted position (see FIG. 1), the squeegee 3 is lowered while the impermeable area 1 is in contact with the web 5. Upon lowering the squeegee, dye is fed through holder 4 and a dye roll or accumulation will come into existence in front of the squeegee 3, so that, as soon as the impermeable area 1 has passed by, the printing of the end motif *a* can start immediately. As soon as the area 1 moves again past the squeegee 3, it is lifted and retained in this position for three revolutions of the stencil(s) A. Hereupon this cycle is repeated and a print web is obtained with a design showing a repeat length greater than the circumference of the stencil(s) concerned. It should be noted that by lifting the internal squeegee 3, the pressure with which the stencil is in contact with the web 5, is considerably decreased, or even reduced to zero. The absence of squeegee pressure from the inner surface of the stencil may cause the stencil surface to position itself in an unstressed position about 1–3 mm above the web. But the stencils themselves are not moved in a vertical direction during this process.

The simplest embodiment of the method according to the invention has been described above, but more complicated products can be manufactured which are clarified with reference to the FIGS. 3–13 in which are also used stencils C and D.

Figure 3:
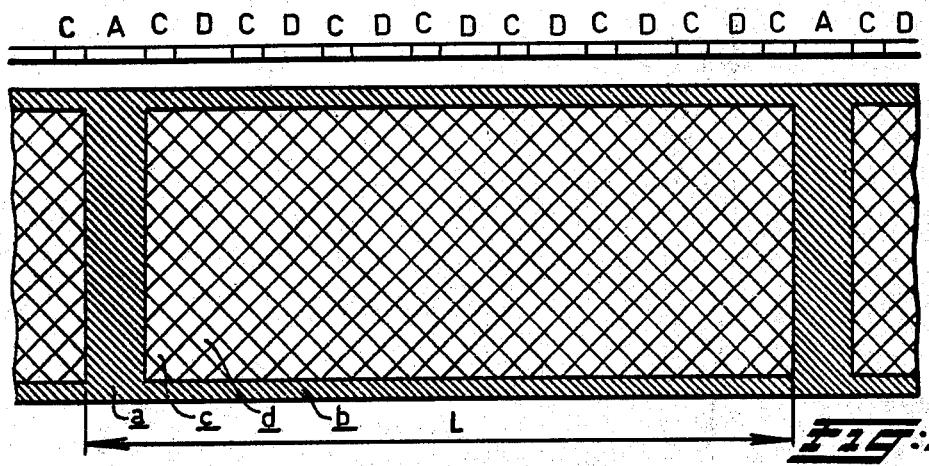
FIG. 3 shows a part of a printed web with a repetitive design consisting of two motifs constituting a so-called kanga.

As is visible in FIG. 3 the web 5 is provided with a design having a central motif which is obtained by means of seven revolutions of the stencils C and D. The central motif is composed of a part or strip *c* which is relatively narrow in a longitudinal direction with respect to the width of the web and a part *d* which is twice the length at strip *c*. The end motif or cross border *a* has the same length as the repetitive design part *d*. Along the edges of the web 5 is a continuous marginal motif *b* which e.g. is the same as the end motif *a*.

In manufacturing the product according to FIG. 3 the web 5 is conveyed past three stencils A, C and D as seen in FIGS. 4–11. Each of these stencils has a circumference equal to the sum of the lengths of the strips $a + c$ $(= d + c)$. The stencil A can print the end motif *a* and has therefore an impermeable area 1, the arcuate length of the area 1 corresponding with the length of the strip *c*. The stencil C serves therefore for printing the repetitive design *c* and has therefore an impermeable area whose arcuate length is equal to the length of the strip *a* or *d*. The repetitive design part *d* is printed by means of the stencil D. This stencil has an impermeable area which corresponds with the area 1 of the stencil A.

The stencil C may be provided near its ends with a circumferential design producing the continuous marginal motif *b*, because the squeegee of this stencil need not be lifted. Such a lifting is, however, indeed the case with the stencils A and D. As an alternative to stencil C, it is possible to apply a separate stencil B which is provided with a design exclusively near its ends, said design being continuous for printing the marginal motif *b*.

The web 5 is passed underneath the stencils A, C and D, only the stencils C and D being operative in the first instance for printing the repetitive central design $c + d$. These stencils are in register with respect to each other such that the strips *d* and *c* adjoin each other. This is visible rightwards in the FIGS. 4–11.

When now the central design $c + d$ has been printed a sufficient number of times, e.g. seven times, the cross border *a* extending in a transverse direction to the web is printed by lowering the lifted squeegee 3 of stencil A. This lowering is effected when the impermeable area is passing by the web 5 (see FIG. 1 and FIG. 5). Subsequently during one revolution of the stencil A the cross border *a* is printed (see FIG. 6), whereupon the squeegee 3 is lifted again when the area 1 is passing (see FIG. 7). The printed cross border *a* passes now by the stencil C and during this passage coincides completely with the impermeable area (see FIG. 8).

Figures 10, 11, 12, 13:
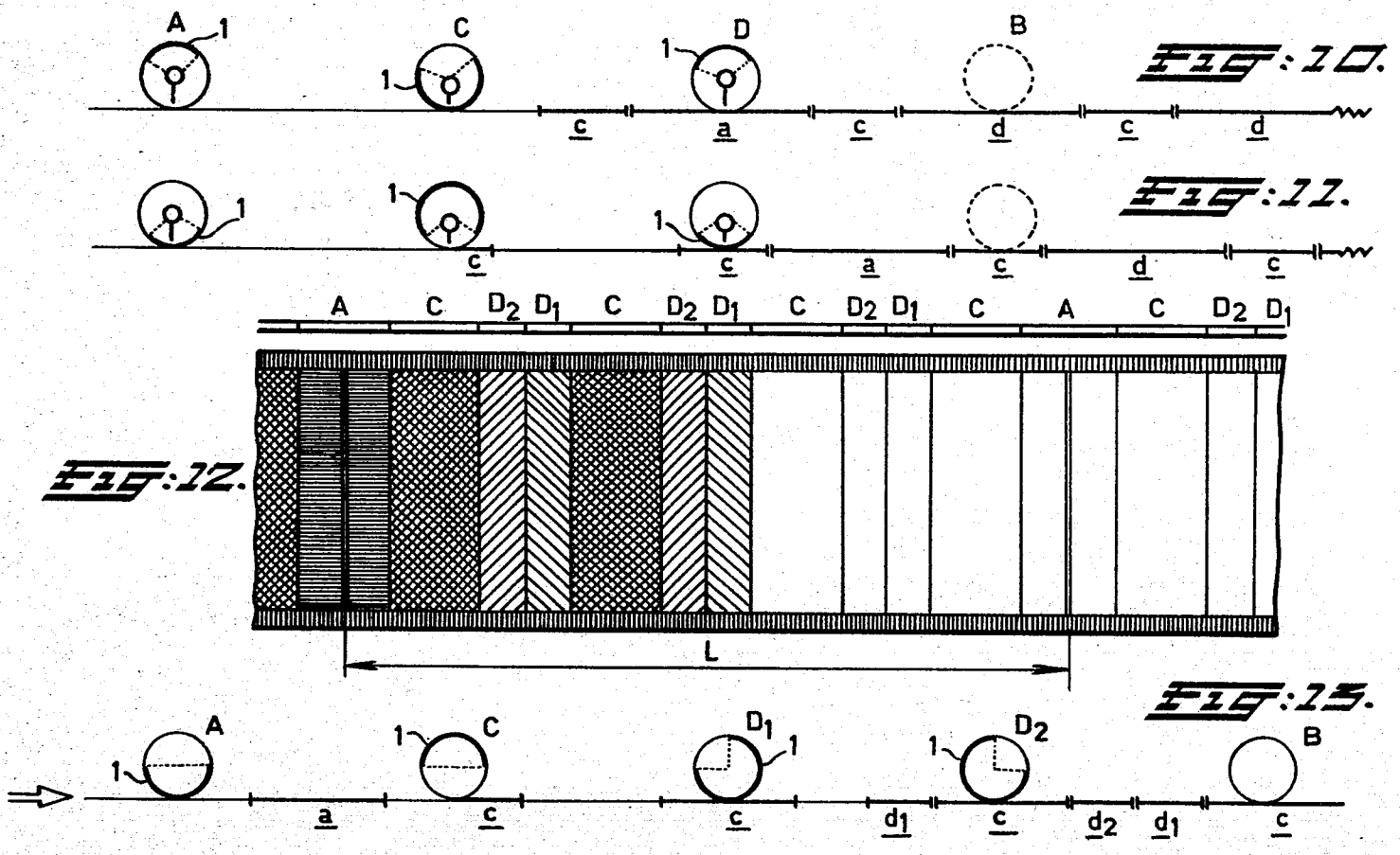

When now the end motif *a* has approached the stencil D, the squeegee in this stencil is lifted (see FIG. 9) so that the part *d* concerned of the repetitive central motif is not printed and the cross border *a* can move past the stencil D (see FIG. 10). The squeegee 3 of the stencil D is lifted for only one revolution so that on the next passage of the impermeable area the squeegee is lowered again (see FIG. 11), whereupon the repetitive design is again printed the desired number of times etc.

The entire cycle consists of 8 revolutions, the stencil A being only operative during 1 revolution and the stencil D during the seven other revolutions. The stencil C (and the stencil B if any) operates (operate) continuously.

In the embodiment according to FIG. 12 the central motif consists of a design, repeating itself several times, which is composed of three parts *c*, $d_1$ and $d_2$. The cross border *a* extending in a transverse direction to the web has an angle of arc or arcuate length corresponding with the length of $d_1 + d_2$. The method proceeds substantially in conformity with what has been described with the squeegees (not shown for the sake of simplicity) of the cylinders $D_1$ and $D_2$ are lifted at the precise moment in order to allow the passage of the cross border *a* which has been printed by the squeegee of the stencil A, which was lowered during one revolution. The final product with a length L can be used as bookcase runner. When a web 5 with a greater width is used the product can serve as a table cover.

It should be noted that in connection with the depicted length ratio of the strips *a*, *c* and *d* of the product according to FIG. 3, the impermeable areas of the stencils A, C and D of the FIGS. 4–11 have angles of arc of 120°, 240° and 120°, respectively. In the product according to FIG. 12 the length of the strip *a* is equal to the sum of the lengths of strips $d_1 + d_2$ and also equal to the length of the strip *c*. The impermeable areas of the stencils A, C, $D_1$ and $D_2$ of FIG. 13 have angles of arc of 180°, 180°, 270° and 270°, respectively.

Figure 14:
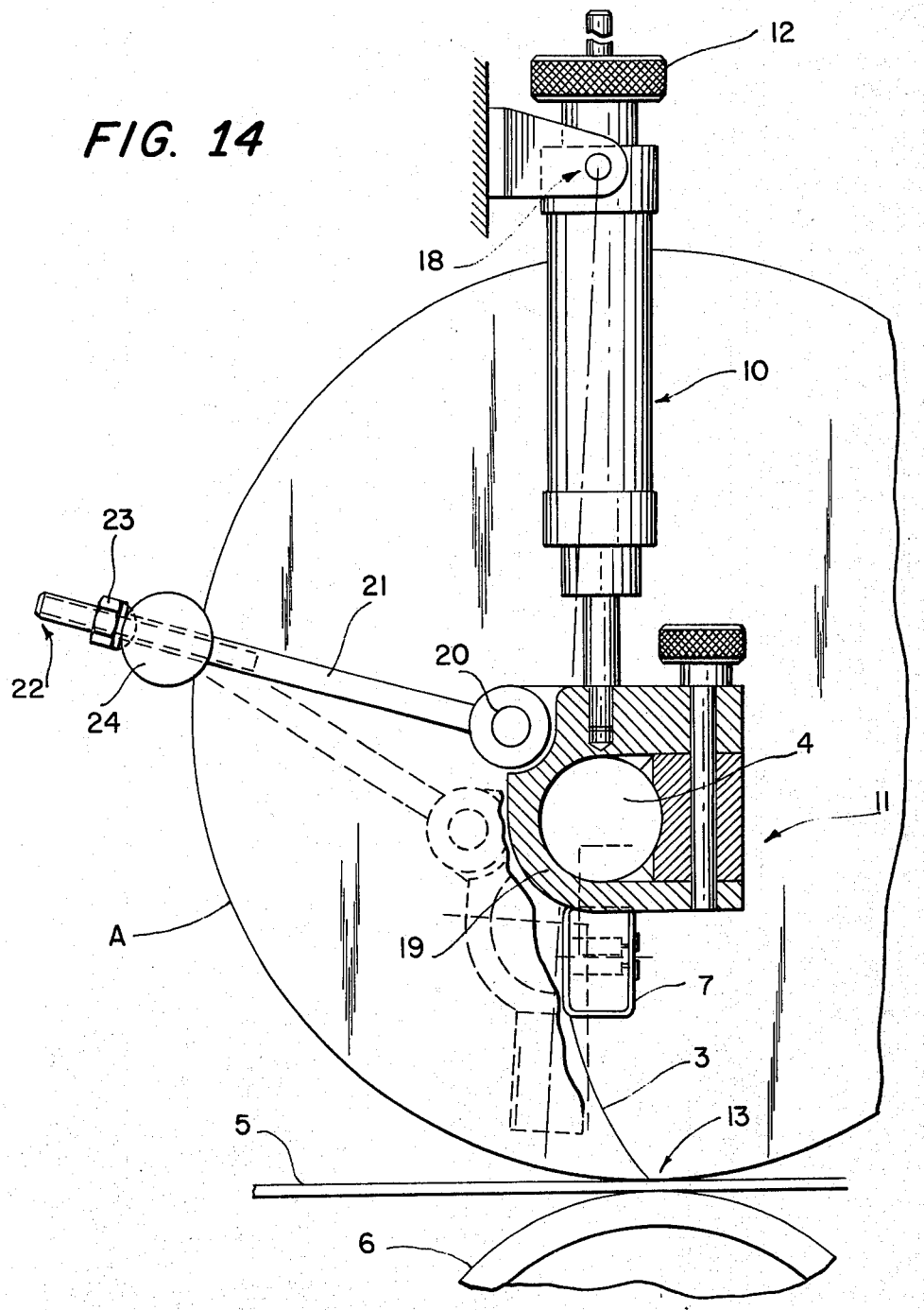
FIG. 14 is a side elevational view of the pneumatic cylinder and associated structure for raising and lowering the squeegee within the stencil.

It should be further noted that the means for lifting and lowering each of the squeegees 3 may consist in a conventional manner of pneumatic or hydraulic jacks provided near the ends of the stencils in order to support the squeegee holders 4 (see FIG. 14). Such structure is disclosed in U.S. Pat. Nos. 3,313,232 and 3,420,167, both issued to the assignee of the present application.

The rotary screen printing machine to which this invention relates is of the type as described, e.g. in the U.S. Pat. Nos. 3,291,044, 3,304,860, 3,313,232 and 3,420,167 wherein e.g. 12 or 16 juxtaposed supporting members are provided for the ends of as many cylindrical stencils which are positioned serially along a printing path. For the purpose of simplicity, this structure is not all represented in the drawings.

The printing machine is provided with suspension members 10 for the squeegee device 11 within each stencil A. The latter device consists of a tubular squeegee holder 4 provided with a fitting 7 for a flexible squeegee blade 3. The machine is further provided with means such a roller 6 for guiding the material to be printed. When this material is sufficiently rigid in itself, it may directly bear on the means 6 embodied as supporting rollers, but in the case of weak material, like e.g. textile, a supporting belt can be applied in the usual way.

The squeegee blade 3 consists of a thin metal strip of stainless steel or spring steel which freely protrudes from the fitting 7. It is also possible to employ a strip of synthetic material, provided this material has an elastic flexibility analogous to that of metal. Such a material may be Vulkolan or Teflon, depending on the type of paste or paint used.

The suspension members 10 each consist of a pneumatic cylinder (see FIGS. 14 and 15), the piston of which is pivotally secured to the squeegee device by suitable bearing means, by which means the squeegee device 11 can be lifted and lowered in order to release the squeegee blade 3 from the cylindrical stencil A or bring it again into contact therewith. The lower position of the squeegee device 11 and as a consequence the angle at which the blade 3 exerts its printing function is adjusted by the aid of an adjusting nut 12.

Each squeegee blade 3 is via its fitting 7 supported at two locations by the squeegee holder 4. This holder is constructed as a tube serving as a printing paste or paint feeding conduit.

Means are provided in each squeegee device 11 cooperating with the squeegee holder 4 in order to displace the latter in a generally horizontal direction during its height adjustment in such a manner, that the pressure area 13 of the squeegee blade 3 is always situated in a substantially fixed zone of the stencil, that is to say, the zone which is in touch with the material to be printed, or a region at a short distance before or after that zone. These means consist of an arm 21 outside at least one end of the stencil A.

In the structure according to FIG. 14 the suspension members 10 are pivoted at 18 to the frame of the machine. Each suspension member 10 is secured to the squeegee holder 4 by means of a clip 19 which loosely surrounds the holder 4 and permits sliding rotational movement thereof relative to the clip 19. These clips are situated outside the ends of each stencil A and are each pivotally connected with one end of arm 21 through a tenon 20. Each arm 21 has at its free end 22 a point of support 24 pivotable about a fixed axis which however is adjustable by means of a nut 23. This construction causes a turning of the squeegee holder 4 on lowering the squeegee device 11 and a tilting of the fitting 7 in such a manner that the pressure area 13 of the squeegee blade 3 remains within the correct region.

In order to control the raising and lowering of the squeegee a control circuit and structure may be employed as illustrated in FIGS. 15, 15*a* and 15*b*. The pneumatic cylinder 10 has positioned therein a compression spring 31 which maintains the squeegee in its raised position. The cylinder 10 is connected through an air line 30 to a source of compressed air through an electromagnetic control valve 32. There is further provided a cam shaft 33 which has a plurality of individual circular cams 35 thereon which are engageable with respective switches 34 to operate the same. The cam shaft 33 is driven through a gear drive 36 by means of a gear 37 mounted on a shaft 38 which is drivingly connected through a worm 39 to a gear 40 which rotates the stencil A. Stencil A is provided on one end thereof with a conical sleeve 42 which is of substantial rigidity and has a gear 41 thereon which meshes with the gear 40. The gear ratio of the drive 36 is such that the cam shaft 33 will make one complete revolution after *n* revolutions of the different stencils. The value *n* will depend upon the pattern to be printed and in the embodiment as shown in FIG. 3 *n* will equal 9. In the embodiment according to FIG. 12, *n* will equal 5. A three-position switch 43 is also provided in circuit as shown.

The cam shaft 33 has a number of individual cams 35 thereon which operate as many switches 34 as there are squeegees 3. As soon as the cam 35 operates the switch 34 the valve 32 will either be energized or de-energized, depending upon the position of the switch 43. When the valve 32 is energized, no air under pressure will flow through the conduit 30 to the cylinder 10 which means that the squeegee will remain in its raised position under the influence of the spring 31.

The three-position switch 43 functions to obtain the possibility of an uninterrupted printing operation of the composite pattern, i.e., an operation without the closing motif A shown in FIGS. 3 and 12 (position of *a*). In the position *b* it is possible to have the normal operation of the machine whereas in the position *c* all of the squeegees are lifted.

The drive of the stencils may be carried out as described above in a manner which is conventional and is known in the art. This drive at the same time provides for a timed driving of the cam shaft to actuate the pneumatic cylinder for the raising and the lowering of the squeegee.

As a result of the invention, it is now possible to manufacture a product which so far could only be obtained in a time consuming process. Such products include sheets, saris, table cloths, and curtain materials which have cross-borders thereon. The method and apparatus readily lend themselves to automation, since after a correct adjustment of the repeat lengths of the various stencils (registering of the stencils), only the lowering and lifting of particular squeegees at the correct moments need to be effected for manufacturing the desired product in a continuous process.

Thus it can be seen that the present invention has disclosed a method and apparatus wherein a number of cylindrical stencils are used but that these stencils are operative for printing at specific time intervals merely by the raising or the lowering of the respective squeegee. Since it is known that the raising or lowering of the squeegee will automatically produce a fading out or fading in of the colors the present invention will give to each stencil an impermeable zone within which the raising or lowering of the squeegee is performed and the remaining area of the stencil is screened or permeable. Therefore, as soon as the screened area of the stencil contacts the material to be printed the squeegee has already been lowered to its normal operative printing position. Only the squeegee itself is raised or lowered and not the cylindrical stencil itself. The stencil remains in contact with or closely adjacent to the material to be printed but no printing will occur as long as the squeegee is in its raised position. The raising of the squeegee reduces the pressure of the stencil upon the material to be printed and thus eliminates any pressure in the printing paste which is therefore unable to penetrate through the screened area. It is to be noted that none of the rotary cylindrical stencils of the present invention is capable of printing over its entire circumferential surface. This means that none of these stencils can be used independently or during a certain time without a simultaneous use of at least one other stencil or screen with a complementary screened area or permeable surface portion.

It is also possible to provide each stencil with two electrical contacts which are closed each time that the impermeable area of the stencil contacts the web or material to be printed. One contact is actuated to raise the squeegee and the other for lowering the squeegee. These contacts of the different stencils are connected in series with a master cam shaft rotating in synchronism with the stencils and having a program permitting the closing of the contacts to either raise or lower the squeegee by means of a solenoid valve which connects a supply of compressed air to the pneumatic cylinders of the squeegee so as to lower the squeegee during the passage of the impermeable area or exhausting the air from the cylinders so that the squeegee will be raised under spring pressure.

It will be understood that this invention is susceptible to modification in order to adapt it to different usages and conditions, and accordingly, it is desired to comprehend such modifications within this invention as may fall within the scope of the appended claims.

What is claimed is:

1. In the process of printing a design on material using a rotary thin-walled cylindrical screen stencil having a squeegee therein wherein the design to be printed has a repeat length greater than the circumference of the stencil, the steps of forming on the screen surface of the stencil an impermeable area extending along a portion of the circumference of the stencil and the remaining portion of the stencil defining a screened area, conveying the material to be printed past the stencil, and vertically moving the squeegee during rotation of the stencil during the time interval that the impermeable area is contiguous with the material to be printed so that fading out and fading in of color during lifting and lowering of the squeegee is prevented, the stencil selectively does not print the material when the squeegee is out of contact with the screen surface and when the impermeable area is contiguous with the material and the stencil prints only when its squeegee is lowered and the screened area passes in contact with the material whereby a design having a repeat length greater than the circumference of the stencil can be printed.

2. In a process as claimed in claim 1 and the steps of printing with a plurality of screen stencils upon a web or sheet of material a design comprising a margin motif and a central motif within the margin motif and different therefrom, the stencils are positioned serially such that one or more stencils can print upon the material, the squeegees of the stencils are periodically raised and lowered to selectively print or not print the material.

* * * * *